US005649376A

United States Patent [19]

Lecates, Jr.

[11] Patent Number: 5,649,376

[45] Date of Patent: Jul. 22, 1997

[54] SNEAKER TO SIMULATE THE SIGHT AND SOUND OF A SNAKE

[76] Inventor: Richard E. Lecates, Jr., 32 Sunset Trail, Medford, N.J. 08055

[21] Appl. No.: 673,565

[22] Filed: Jul. 1, 1996

[51] Int. Cl.[6] ..... A43B 23/24; A43B 23/26

[52] U.S. Cl. ..... 36/137; 36/139; 36/54

[58] Field of Search ..... 36/112, 137, 139, 36/54

[56] References Cited

U.S. PATENT DOCUMENTS

| | | | |
|---|---|---|---|
| D. 77,932 | 3/1929 | Blum | 36/112 X |
| 1,823,634 | 9/1931 | Wiesner | 36/112 X |
| 2,291,791 | 8/1942 | Casserd | 36/139 X |
| 3,070,907 | 1/1963 | Rocco | 36/137 X |
| 3,564,232 | 2/1971 | Ellerbe | 36/137 X |
| 4,324,054 | 4/1982 | Rovinsky | 36/112 X |
| 5,381,615 | 1/1995 | MacMillan | 36/137 |

FOREIGN PATENT DOCUMENTS

| | | | |
|---|---|---|---|
| 499502 | 5/1930 | Germany | 36/112 |
| 2263386 | 7/1993 | United Kingdom | 36/157 |

*Primary Examiner*—Ted Kavanaugh

[57] ABSTRACT

A sneaker adapted to simulate the sight and sound of a snake is disclosed. Such sneaker comprises a sole and an upper surface, the sole having a periphery therearound with a front toe section and a rear heel end section. Further provided is an upper having a lower periphery coupled with respect to the periphery of the sole and having upwardly extending portions to generally encompass the foot and lower ankle of a wearer. An elongated tongue is coupled with respect to the upper. It also has a free upper end extending upwardly beyond the upper, the free upper end being formed in the shape of a face. An electrical system including a pair of lamps is positioned adjacent to the upper end of the tongue to simulate the eyes of a face and a battery is positioned within the sole at the toe section. Electrical lines couple the lamps and the battery with an associated pressure switch extending beneath the battery whereby walking with the sneaker will periodically provide pressure to the pressure switch to generate power from the battery to the lamps and thereby cause the lamps to turn off and on when a user walks with the sneaker.

2 Claims, 3 Drawing Sheets

FIG. 5
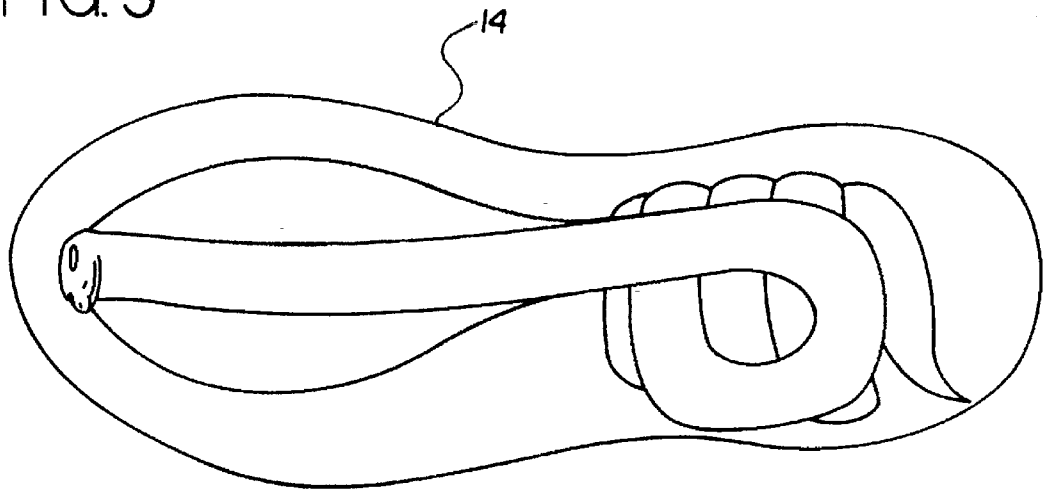
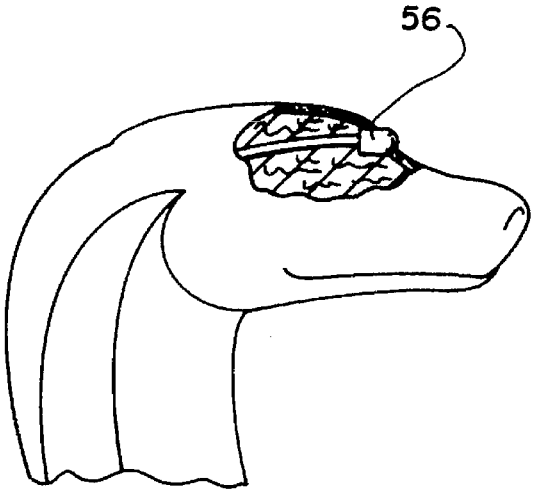
FIG. 6

SNEAKER TO SIMULATE THE SIGHT AND SOUND OF A SNAKE

BACKGROUND OF THE INVENTION

1. Field of the Invention

The present invention relates to a sneaker and, more particularly, pertains to ornamenting a sneaker to simulate the sight and sound of a snake.

2. Description of the Prior Art

The use of sneakers, shoes and other footwear of various designs and configurations is known in the prior art. More specifically, sneakers, shoes and other footwear of various designs and configurations heretofore devised and utilized for the purpose of ornamenting footwear through various methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art in U.S. Pat. No. 4,995,173 to Spier discloses a high tech footwear with foot-actuated pump and expandable air bladders.

U.S. Pat. No. 4,009,528 to Villari, Jr. et al. discloses a sneaker with insole.

U.S. Pat. No. 4,610,102 to Hill discloses a velcro-encapsulated label for shoes and the like.

U.S. Pat. No. Des. 333,204 to Terrell discloses an ornamental design for an interchangeable sneaker.

U.S. Pat. No. Des. 306,513 to Sachs et al. discloses an ornamental design for a sneaker with a characteristic feature of an oxford look.

Lastly, U.S. Pat. No. Des. 257,074 to Gucci discloses an ornamental design for a sneaker with the characteristic feature of a GG monogram.

In this respect, the sneaker according to the present invention substantially departs from the conventional concepts and designs of the prior art, and in so doing provides an apparatus primarily developed for the purpose of ornamenting a sneaker to simulate the sight and sound of a snake.

Therefore, it can be appreciated that there exists a continuing need for a new and improved sneaker which can be used for ornamenting a sneaker to simulate the sight and sound of a snake. In this regard, the present invention substantially fulfills this need.

SUMMARY OF THE INVENTION

In view of the foregoing disadvantages inherent in the known types of sneakers, shoes and other footwear of various designs and configurations now present in the prior art, the present invention provides an improved sneaker. As such, the general purpose of the present invention, which will be described subsequently in greater detail, is to provide a new and improved sneaker and method which has all the advantages of the prior art and none of the disadvantages.

To attain this, the present invention essentially comprises a new and improved sneaker adapted to simulate the sight and sound of a snake comprising, in combination, a sole positionable in a generally horizontal plane, having a lower surface adapted to be positioned on a recipient surface and having an upper surface adapted for supporting the foot of a wearer and having a periphery therearound, the sole having a front toe section and a rear heel end section; an upper having a lower periphery coupled with respect to the periphery of the sole and having upwardly extending portions to generally encompass the foot and lower ankle of a wearer, the upper having an opening in a front extent thereof to allow the putting on and taking off of the sneaker by a user, the opening having lace apertures along each side thereof; a lace positioned through the apertures for securing the sneaker upon the user; an elongated tongue coupled with respect to the upper and having a lower end coupled to the upper at the lower extent of the opening and having a free upper end extending upwardly beyond the upper, the free upper end being formed in the shape of a snake head; an electrical system including a pair of lamps positioned adjacent to the upper end of the tongue to simulate the eyes of a snake and a battery positioned within the sole at the toe section and with electrical lines coupling the lamps and the battery with an associated pressure switch extending beneath the battery to exterior of the sole whereby walking with the sneaker will periodically provide pressure to the pressure switch to generate power from the battery to the lamps and thereby cause the lamps to turn off and on when a user walks with the sneaker; and a hollow chamber of plastic positioned within the sole at the heel section with a plurality of metal balls therein to effect the noise of a snake rattle when a user walks with the sneaker.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sneaker which has all the advantages of the prior art sneakers, shoes and other footwear of various designs and configurations and none of the disadvantages.

It is another object of the present invention to provide a new and improved sneaker which may be easily and efficiently manufactured and marketed.

It is a further object of the present invention to provide a new and improved sneaker which is of a durable and reliable construction.

An even further object of the present invention is to provide a new and improved sneaker which is susceptible of a low cost of manufacture with regard to both materials and labor, and which accordingly is then susceptible of low prices of sale to the consuming public, thereby making such sneakers, shoes and other footwear of various designs and configurations economically available to the buying public.

Even still another object of the present invention is to ornament a sneaker to simulate the sight and sound of a snake.

Lastly, it is an object of the present invention to provide a sneaker adapted to simulate the sight and sound of a snake. Such sneaker comprises a sole positionable in a generally horizontal plane. Such sole has a lower surface adapted to be positioned on a recipient surface and an upper surface adapted for supporting the foot of a wearer. The sole also has a periphery therearound with a front toe section and a rear heel end section. Further provided is an upper having a lower periphery coupled with respect to the periphery of the sole and having upwardly extending portions to generally encompass the foot and lower ankle of a wearer. The upper has an opening in a front extent thereof to allow the putting on and taking off of the sneaker by a user. An elongated tongue is coupled with respect to the upper and has a lower end coupled to the upper at the lower extent of the opening. It also has a free upper end extending upwardly beyond the upper, the free upper end being formed in the shape of a face. An electrical system including a pair of lamps is positioned adjacent to the upper end of the tongue to simulate the eyes of a face and a battery is positioned within the sole at the toe section. Electrical lines couple the lamps and the battery with an associated pressure switch extending beneath the battery whereby walking with the sneaker will periodically provide pressure to the pressure switch to generate power from the battery to the lamps and thereby cause the lamps to turn off and on when a user walks with the sneaker.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a bottom elevational view of the sneaker shown in the prior Figures.

FIG. 6 is an enlarged cross-sectional head of the top of the tongue shown in FIGS. 1 and 2 but with parts broken away to show certain internal constructions thereof.

The same reference numerals refer to the same parts throughout the various Figures.

DESCRIPTION OF THE PREFERRED EMBODIMENT

Figure 1:
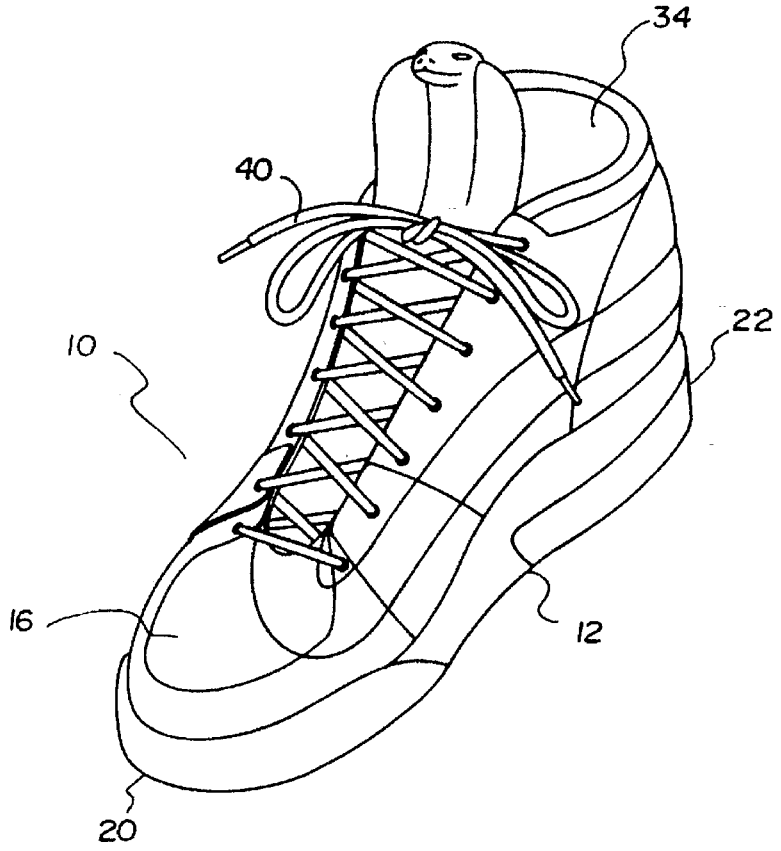
FIG. 1 is a perspective illustration of the preferred embodiment of the new and improved sneaker constructed in accordance with the principles of the present invention.
Figure 2:
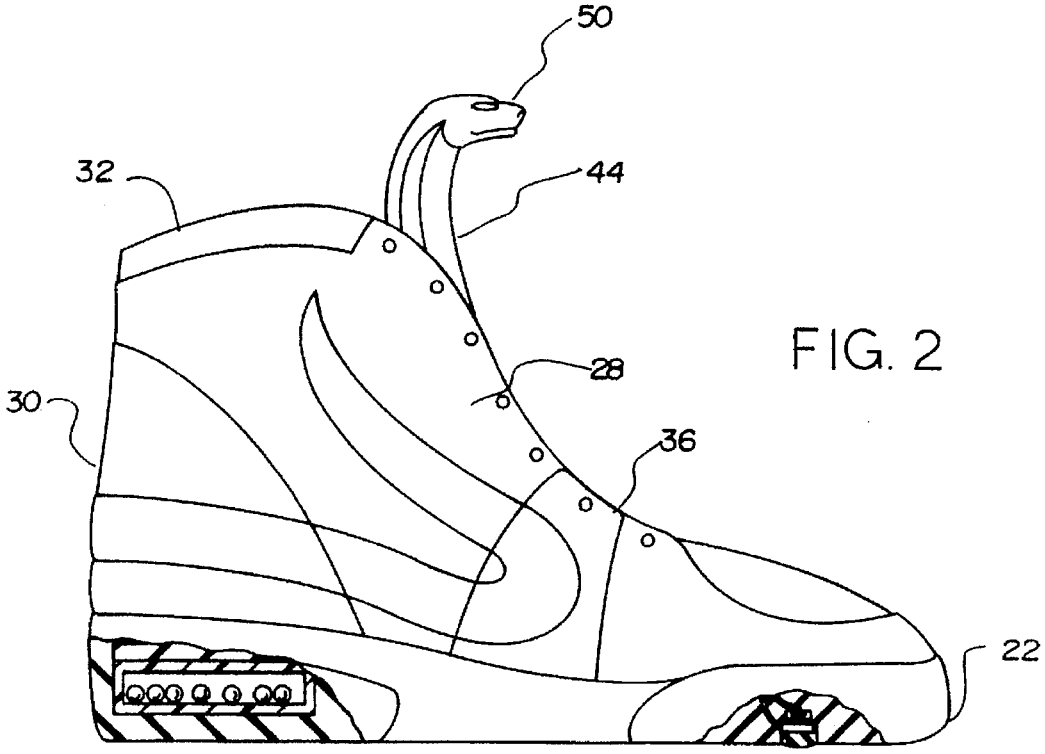
FIG. 2 is a side elevational view of the sneaker shown in FIG. 1 but with parts broken away to show certain internal constructions thereof.
Figure 3:
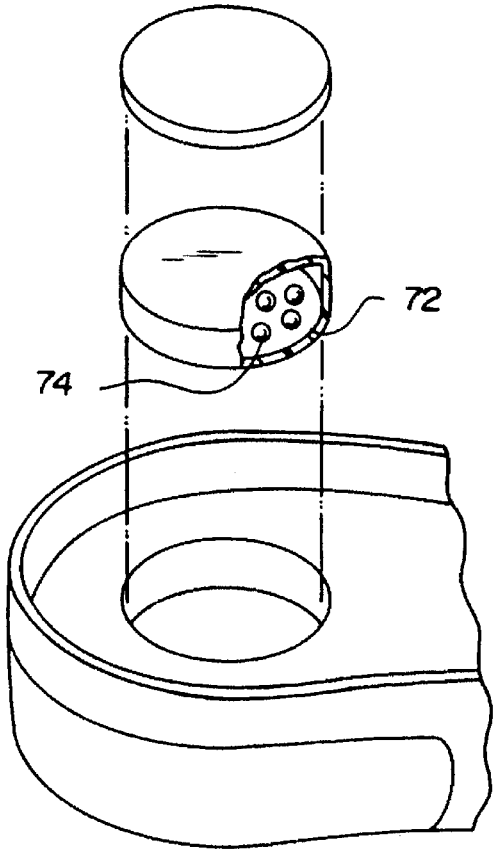
FIG. 3 is an exploded perspective view of the rear heel portion of the sole illustrating the sound-creating components therein.
Figure 4:
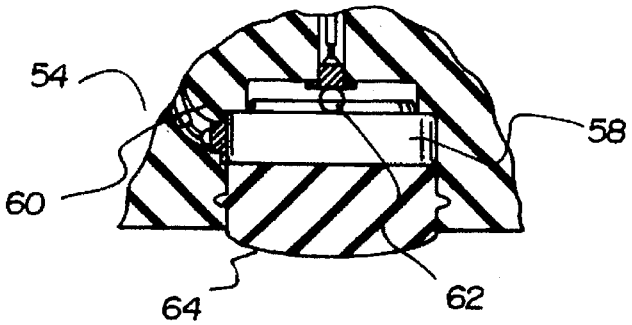
FIG. 4 is an enlarged cross-sectional view of the front toe portion of the sneaker shown in the broken-away portion of FIG. 2.

With reference now to the drawings, and in particular to FIG. 1 thereof, the preferred embodiment of the new and improved sneaker embodying the principles and concepts of the present invention and generally designated by the reference numeral 10 will be described.

The present invention, the new and improved sneaker, is a system 10 comprised of a plurality of components. In their broadest context, the components include a sole, an upper, a lace, a tongue, an electrical system and a hollow chamber positioned within the sole. Each of the individual components is specifically configured and correlated one with respect to the other so as to attain the desired objectives.

More specifically, the sneaker 10 of the present invention has, as its major component, a sole 12. The sole is fabricated of a flexible resilient elastomeric material. It is positionable in a generally horizontal plane. The sole is formed to have a lower surface 14. Such lower surface is adapted to be positioned on a recipient surface such as the floor or ground when walking with the sneaker being worn. The sole is also formed to have an upper surface 16. The upper surface is adapted for receiving and supporting the foot of a wearer. The sole has a periphery 18 therearound to generally conform to the periphery of a wearer's foot. In addition, the sole has a front toe section 20 and a rear heel section 22. It should be understood that although only a single sneaker is disclosed herein, it is normal to wear a pair of such sneakers during normal use.

Next provided as a major component of the sneaker, or system 10, is an upper 26. The upper is formed to have a lower periphery 28. Such periphery is coupled with respect to the periphery of the sole as by an adhesive or stitching. The upper has upwardly extending portions 30 extending upwardly from the periphery of the sole. Such upwardly extending portions generally encompass the foot and lower ankle of a wearer with a space 32 for the ankle and leg to extend upwardly therefrom. The upper is also formed to have an opening 34 in the front extent thereof. Such opening is to allow the putting on and taking off the sneaker by the user. The opening is formed to include lace apertures 36 in the upper on opposite sides of the opening.

Selective opening and closing of the opening in the upper is effected through a pair of laces, one lace 40 for each sneaker. Such lace is passed back and forth through the apertures and tied at the top for securing the sneaker upon the user.

One additional part of the upper is the tongue 44. The tongue is a flexible elongated member. The tongue has a lower end 46 coupled to the upper adjacent to the lower extent of the opening. The tongue also has an upper end 48. Such upper end preferably extends upwardly above and beyond the upper extent of the upper. The upper end of the tongue is formed in the shape of an object, preferably a face, most preferably in the shape of a snake head 50.

Operatively coupled with respect to the sneaker as above described is an electrical system 54. The electrical system includes a pair of lamps 56. Such lamps are positioned adjacent to the upper end of the tongue. They are located centrally positioned in the snake head to simulate the eyes of a snake. In addition, the electrical system includes a power source such as a battery 58. The battery is preferably of a small disc-shaped configuration. The battery is positioned within the sole adjacent to the toe section. In association therewith, there are provided electrical lines 60. The electrical lines couple at their upper end to the lamps and at their lower ends to the battery. In addition, an associated pressure switch 62 is coupled between the lower ends of the wires and the battery and has, in association therewith, a rubber plug 64 with a peripheral flange 66 located within the recess 68 of the sole. In this manner, the exertion of pressure on the plug will urge the battery upwardly to close the plug to allow the pressure switch to effect a flow of current from the battery to the wires and to the lamps. This will cause the lamps to turn off and on when a user walks with the sneaker and periodically causes pressure on the plug, battery and pressure switch.

Lastly provided as a component of the system 10 are sound-generating components. The major element of these sound-generating components is a hollow chamber 72. Such chamber is of a cylindrical configuration and preferably fabricated of plastic. Such chamber is preferably positioned within the sole of the sneaker within the heel section. Within the chamber is a plurality of balls 74. Such balls are preferably fabricated of metal. In this manner, when the balls move within the chamber as caused by a person walking with such sound-generating components within the sole of the sneaker, a noise is effected of a rattling sensation. Such noise simulates the rattle of a snake. As a result, the use of the sneakers by a wearer will not only effect a visual sensation and a sound sensation correlated to the speed of walking or running by the user, but such sound and sight sensations will be correlated with respect to each other in terms of speed and frequency.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved sneaker adapted to simulate the sight and sound of a snake comprising, in combination:

a sole positionable in a generally horizontal plane, having a lower surface adapted to be positioned on a recipient surface and having an upper surface adapted for supporting the foot of a wearer and having a periphery therearound, the sole having a front toe section and a rear heel end section;

an upper having a lower periphery coupled with respect to the periphery of the sole and having upwardly extending portions to generally encompass the foot and lower ankle of a wearer, the upper having an opening in a front extent thereof to allow the putting on and taking off of the sneaker by a user, the opening having lace apertures along each side thereof;

a lace positioned through the apertures for securing the sneaker upon the user;

an elongated tongue coupled with respect to the upper and having a lower end coupled to the upper at the lower extent of the opening and having a free upper end extending upwardly beyond the upper, the free upper end being formed in the shape of a snake head;

an electrical system including a pair of lamps positioned adjacent to the upper end of the tongue to simulate the eyes of a snake and a battery positioned within the sole at the toe section and with electrical lines coupling the lamps and the battery with an associated pressure switch extending beneath the battery to exterior of the sole whereby walking with the sneaker will periodically provide pressure to the pressure switch to generate power from the battery to the lamps and thereby cause the lamps to turn off and on when a user walks with the sneaker; and a hollow chamber of plastic positioned within the sole at the heel section with a plurality of metal balls therein to effect the noise of a snake rattle when a user walks with the sneaker.

2. A sneaker adapted to simulate the sight and sound of a snake comprising:

a sole positionable in a generally horizontal plane, having a lower surface adapted to be positioned on a recipient surface and having an upper surface adapted for supporting the foot of a wearer and having a periphery therearound, the sole having a front toe section and a rear heal section;

an upper having a lower periphery coupled with respect to the periphery of the sole and having upwardly extending portions to generally encompass the foot and lower ankle of a wearer, the upper having an opening in an front extent thereof to allow the putting on and taking off of the sneaker by the user;

an elongated tongue coupled with respect to the upper and having a lower end coupled to the upper at the lower extent of the opening and having a free upper end extending upwardly beyond the upper, the free upper end being formed in the shape of a face;

an electrical system including a pair of lamps positioned adjacent to the upper end of the tongue to simulate the eyes of a face and a battery positioned within the sole at the toe section and with electrical lines coupling the lamps and the battery whereby walking with the sneaker will periodically provide pressure to the pressure switch to generate power from the battery to the lamps and thereby cause the lamps to turn off and on when a user walks with the sneaker a hollow chamber of plastic positioned within the sole at the heel section with a plurality of metal balls therein to effect the noise of a snake when a user walks with the sneaker.

* * * * *